US010422597B2

(12) United States Patent
Carsey

(10) Patent No.: US 10,422,597 B2
(45) Date of Patent: Sep. 24, 2019

(54) LOCKING DEVICE FOR RIFLE MAGAZINE RELEASE

(71) Applicant: CARSEYCO INC., Fallbrook, CA (US)

(72) Inventor: Mark Carsey, Fallbrook, CA (US)

(73) Assignee: CARSEYCO INC., Fallbrook, CA (US)

( * ) Notice: Subject to any disclaimer, the term of this patent is extended or adjusted under 35 U.S.C. 154(b) by 0 days.

(21) Appl. No.: 15/808,590

(22) Filed: Nov. 9, 2017

(65) Prior Publication Data

US 2018/0128562 A1 May 10, 2018

Related U.S. Application Data

(60) Provisional application No. 62/419,902, filed on Nov. 9, 2016.

(51) Int. Cl.

| | |
|---|---|
| ***F41A 17/38*** | (2006.01) |
| ***F41A 9/59*** | (2006.01) |
| ***F41A 3/66*** | (2006.01) |
| ***F41A 11/00*** | (2006.01) |

(52) U.S. Cl.
CPC ..... *F41A 9/59* (2013.01); *F41A 3/66* (2013.01); *F41A 11/00* (2013.01); *F41A 17/38* (2013.01)

(58) Field of Classification Search
CPC .... F41A 9/59; F41A 3/66; F41A 17/38; F41A 3/58; F41A 17/36; F41A 11/00
See application file for complete search history.

(56) References Cited

U.S. PATENT DOCUMENTS

2015/0082678 A1* 3/2015 Jacobson ..... F41A 17/38 42/8
2018/0106567 A1* 4/2018 Meyers ..... F41A 17/38

FOREIGN PATENT DOCUMENTS

CA 2962313 A1 * 9/2017 ..... F41A 3/66

* cited by examiner

*Primary Examiner* — Stephen Johnson
(74) *Attorney, Agent, or Firm* — Kilpatrick Townsend & Stockton LLP

(57) ABSTRACT

Embodiments of the invention pertain to a magazine release interlock mechanism that enables a magazine of a rifle to only be released when the receiver is in an open position. The mechanism includes a translatable pin, a compression spring and a retainer. A fixture and a method for retrofitting a rifle are disclosed.

12 Claims, 10 Drawing Sheets

LOCKING DEVICE FOR RIFLE MAGAZINE RELEASE

CROSS-REFERENCES TO OTHER APPLICATIONS

This application claims priority to U.S. provisional patent application Ser. No. 62/419,902, for "LOCKING DEVICE FOR RIFLE MAGAZINE RELEASE" filed on Nov. 9, 2016 which is hereby incorporated by reference in entirety for all purposes.

FIELD

The described embodiments relate generally to rifles having a removable magazine and in particular to a mechanism that prevents the magazine from being removed until a receiver of the rifle is in an open position.

BACKGROUND

The laws regarding firearm safety and regulations are in a constant state of flux. In some cases a firearm that used to be legal may become illegal and to make it legal the owner must add certain features to the firearm to make it comply with the new regulations. In some cases the modifications can be performed with the use of a kit that can be used to modify the firearm.

SUMMARY

Some embodiments of the present disclosure relate to a modification kit for a firearm to prevent the magazine release button from being operated while the receiver of the firearm is in a closed position.

In some embodiments a locking mechanism for a magazine release device on a firearm comprises a bidirectional mechanism that disables the magazine release device from operating when a receiver of the firearm is in a closed position and enables the magazine release device to be operable by a user when the receiver of the firearm is in an open position.

In some embodiments a rifle modification kit comprises a translatable pin, a compression spring, and a retainer wherein the translatable pin is configured to be positioned within a cavity formed in a receiver of the rifle such that when a receiver of the rifle is in a closed position the translatable pin is held in an engaged position such that a magazine release button is disabled and when the receiver of the rifle is in an open position the compression spring forces the translatable pin to a disengaged position such that the magazine release button is enabled.

In some embodiments a method of forming a locking mechanism for a magazine release device on a firearm comprises locating and securing a fixture on a lower receiver of the firearm, forming a primary bore of a cavity within the lower receiver and forming a secondary bore of the cavity. The fixture is removed and the method further comprises inserting a compression spring within the cavity, inserting a translatable pin within the cavity, and positioning a retainer within the cavity.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure.

Also, as a general rule, and unless it is evident to the contrary from the description, where elements in different figures use identical reference numbers, the elements are generally either identical or at least similar in function or purpose.

DETAILED DESCRIPTION

Some embodiments of the present disclosure relate to magazine release interlock mechanisms for rifles that are actuated by opening and closing a receiver of the rifle. Various embodiments relate magazine release interlock mechanisms that are installed during the initial production and manufacture of the rifle while other embodiments relate to so-called "aftermarket" kits that can be used to modify rifles that are already manufactured and in the field. While the present disclosure can be useful for a wide variety of configurations, some embodiments of the disclosure are particularly useful for AR-15 rifles, as described in more detail below.

Figure 1:
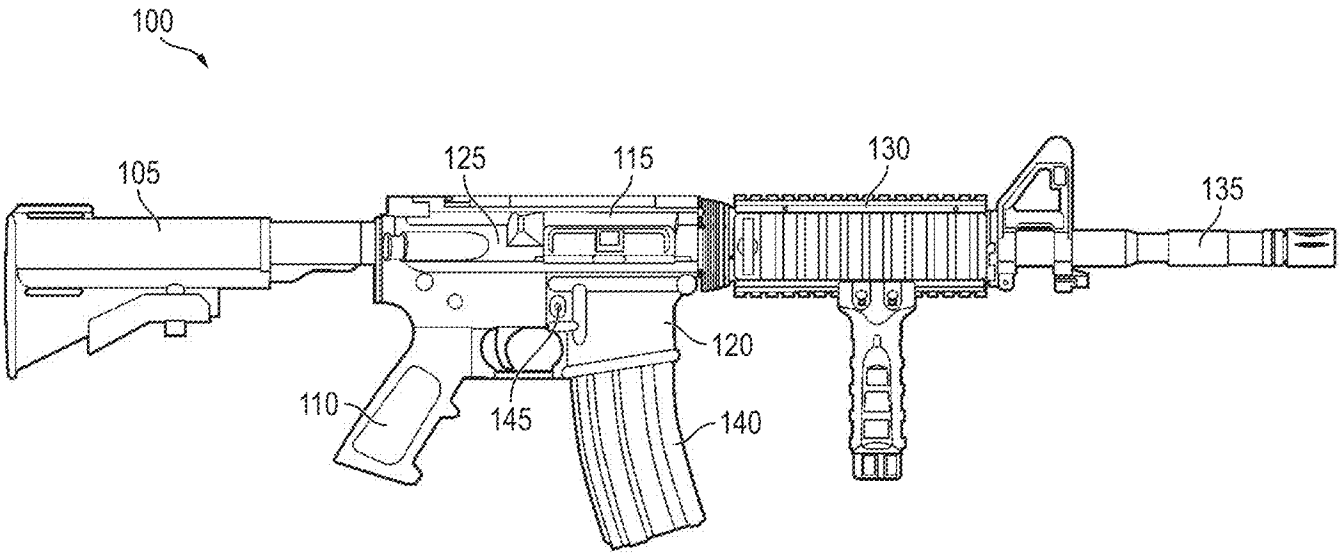
FIG. 1 is a side view of a rifle according to an embodiment of the disclosure.

FIG. 1 depicts an illustrative rendering of a rifle with a removable magazine, according to some embodiments of the disclosure. As shown in FIG. 1, rifle 100 has a butt stock 105, a hand grip 110, a receiver 115 that includes a lower receiver 120 and an upper receiver 125, a hand guard 130, a barrel 135 and a removable magazine 140. Magazine 140 is removable from lower receiver 120 by depressing magazine release button 145. A magazine release interlock mechanism (not shown in FIG. 1) prevents magazine 140 from being released until receiver 115 is in an open position, as described in more detail below.

Figure 2:
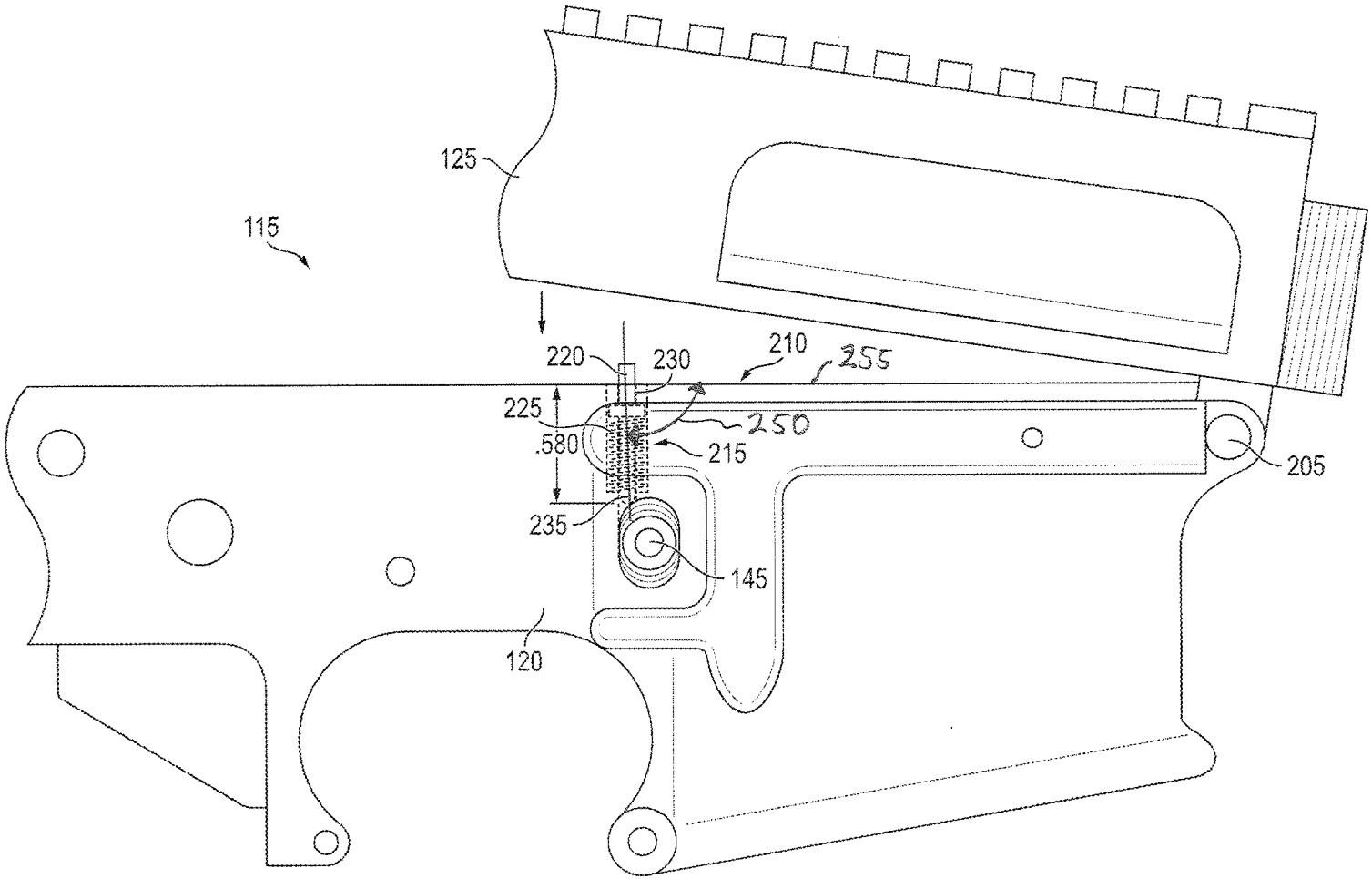
FIG. 2 is a close up view of a receiver of the rifle of FIG. 1 in an open position.

Now referring to FIG. 2 a simplified view of receiver 115 in a partially open position is illustrated. As shown in FIG. 2, upper receiver 125 is pivotably coupled to lower receiver 120 by a pivot 205. When in the fully open position, upper receiver 125 is rotated away from lower receiver 120 such that lower receiver chamber 210 is accessible. When in the closed position (shown in FIG. 1) upper receiver 125 is rotated towards lower receiver 120 and latched into place with one or more takedown locks (not shown in FIG. 2).

Magazine release button 145 is located on lower receiver 120. Magazine release interlock mechanism 215 (shown in dashed lines) is positioned within lower receiver 120 and includes a translatable pin 220, a compression spring 225 and a retainer 230. When receiver 115 is in an open position (shown in FIG. 2) compression spring 225 forces translatable pin 220 against retainer 230 and a locking portion 235 of the translatable pin is moved away from magazine release button 145 so the button is operable. When receiver 115 is in a closed position (shown in FIG. 1), translatable pin 220 is forced into lower receiver 120 such that locking portion 235 of translatable pin 220 is positioned behind magazine release button 145, preventing the button from being depressed. Magazine release interlock mechanism 215 is shown in greater detail below.

In some embodiments magazine release interlock mechanism 215 is positioned at an angle 250 with respect to a top surface 255 of lower receiver 120. More specifically, in some embodiments angle 250 is between 80 and 90 degrees and in some embodiments is between 85 and 87 degrees and in one embodiment is 87 degrees. In some embodiments angle 250 enables locking portion 235 of translatable pin to be positioned behind magazine release button 145 to provide a reliable interlock to prevent the magazine release button from being depressed when receiver 115 is closed. Angle 250 will be explained in more detail below with regard to FIG. 5.

Figure 4:
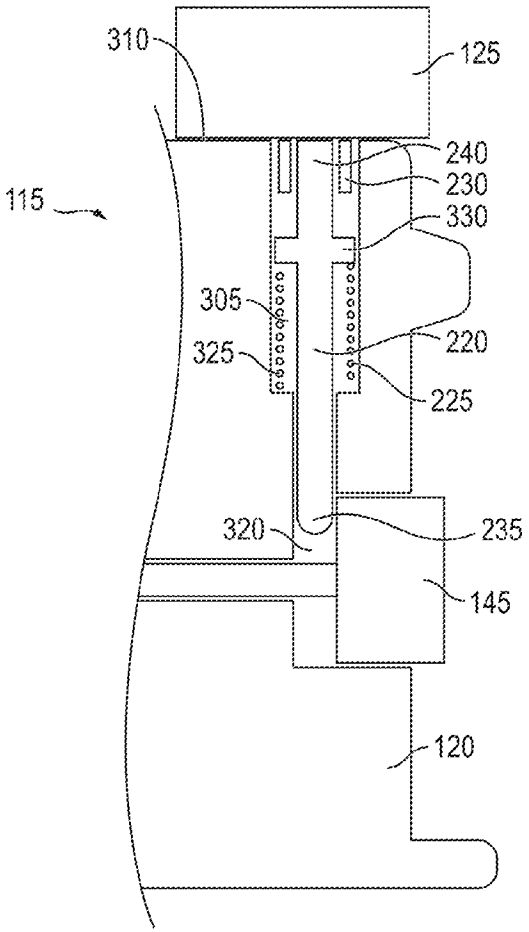
FIG. 4 is a partial cross-sectional view of a magazine release interlock mechanism employed in the rifle shown in FIG. 1 with the receiver in a closed position.
Figure 3:
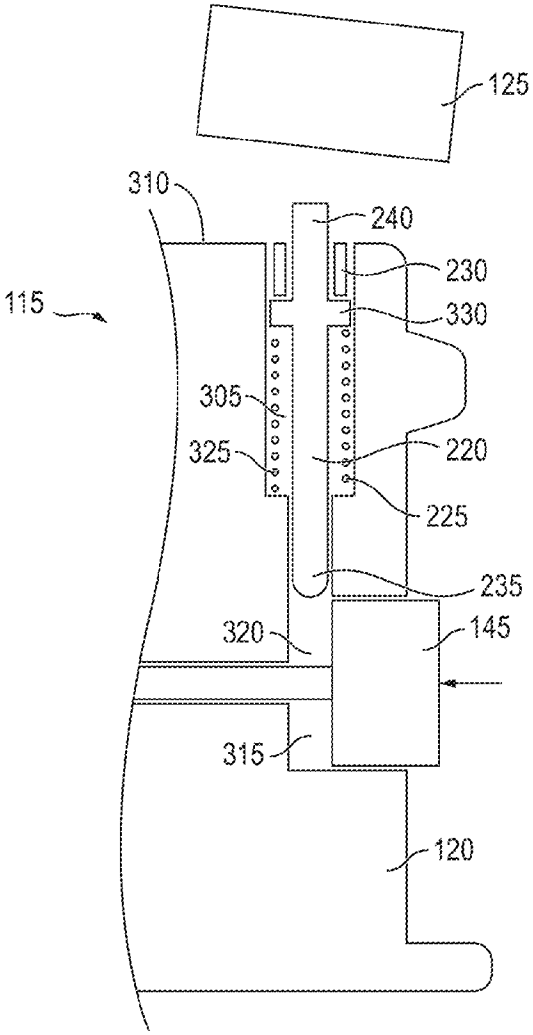
FIG. 3 is a partial cross-sectional view of a magazine release interlock mechanism employed in the rifle shown in FIG. 1 with the receiver in an open position.

Now referring to FIGS. 3 and 4, cross-sections of lower receiver 120 in the regions of magazine release interlock mechanism 215 are illustrated. FIG. 3 illustrates receiver 115 in the open position and FIG. 4 illustrates the receiver in the closed position.

Magazine release interlock mechanism 215 fits within a cavity 305 formed within lower receiver 120. In some embodiments, cavity 305 extends from a top surface 310 of lower receiver 120 to a recess 315 that receives magazine release button 145. In some embodiments cavity 305 includes a primary bore 320 of a first diameter and a secondary bore 325 of a second diameter. Translatable pin 220 has a locking portion 235, a shoulder portion 330 and an actuation portion 240.

As shown in FIG. 3, when receiver 115 is in the open position, upper receiver 125 is moved away from lower receiver 120 such that magazine release interlock mechanism 215 is disengaged. More specifically, translatable pin is forced against retainer 230 by compression spring 225 such that locking portion 235 is removed from recess 315 such that magazine release button 145 can be depressed (translated to the left in FIG. 3).

As shown in FIG. 4, when receiver 115 is in the closed position, upper receiver 125 is moved towards lower receiver 120 such that the upper and lower receiver are in contact with each other. In the closed position, magazine release interlock mechanism 215 is engaged, preventing magazine 140 (see FIG. 1) from being released. More specifically, actuation portion 240 of translatable pin 220 is pushed into lower receiver 120 by upper receiver 125, causing compression spring 225 to compress and locking portion 235 to be inserted into recess 315. In this position, locking portion 235 prevents magazine release button 145 from being depressed (e.g., pushed to the left into recess 315 in FIG. 4) and releasing magazine 140 (see FIG. 1).

Figure 5:
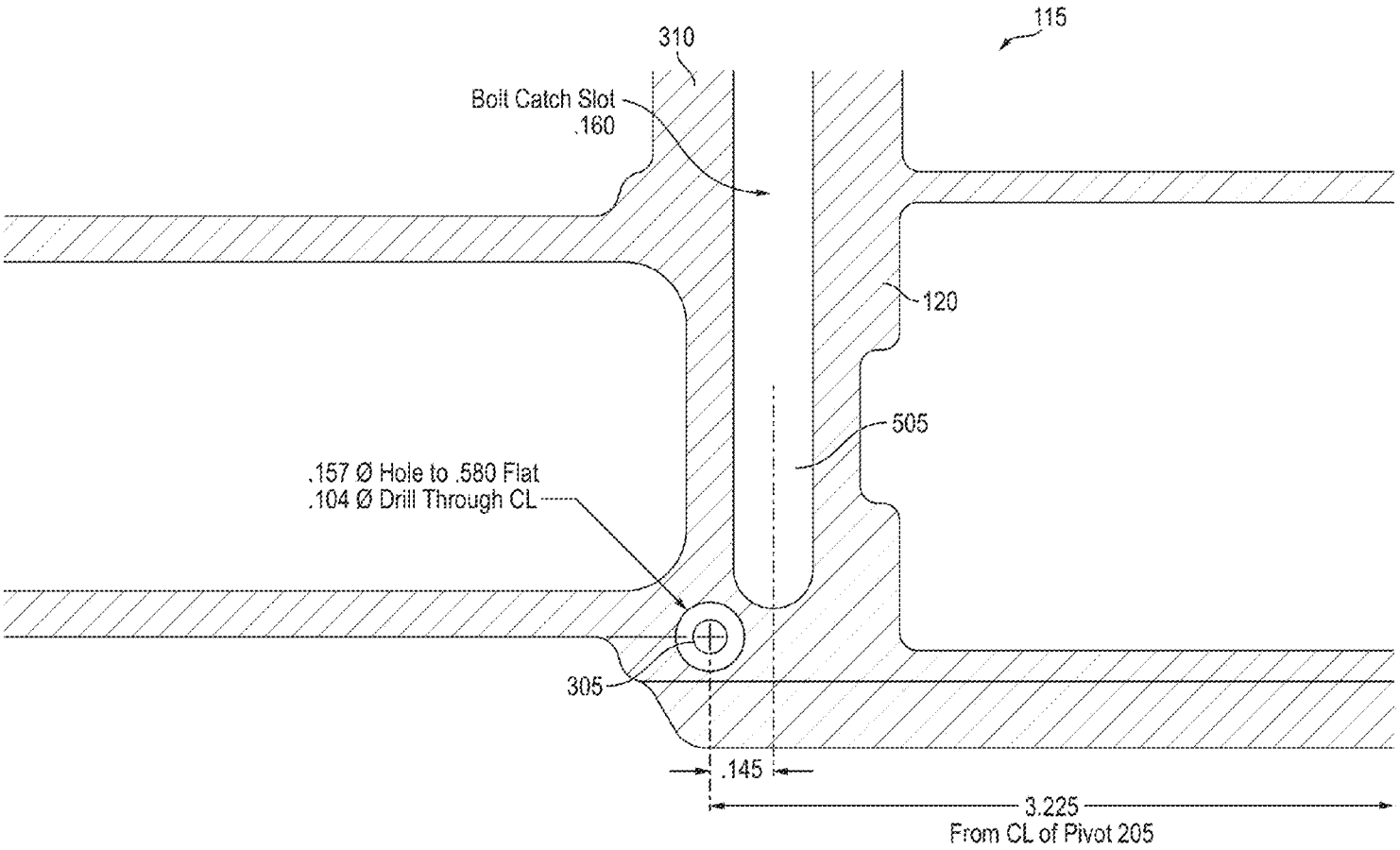
FIG. 5 is a partial view of a top surface of the lower receiver of the rifle shown in FIG. 1.

Now referring to FIG. 5, one embodiment of a position of cavity 305 for magazine release interlock mechanism 215 is illustrated. This disclosure is not limited to the position for cavity 305 illustrated in FIG. 5 and other positions for cavity are within the scope of this disclosure. As shown in FIG. 5, cavity 305 can be positioned on top surface 310 of lower receiver 120. Approximate dimension from pivot 205 (see FIG. 2) and a bolt catch slot 505 are illustrated.

Figure 10:
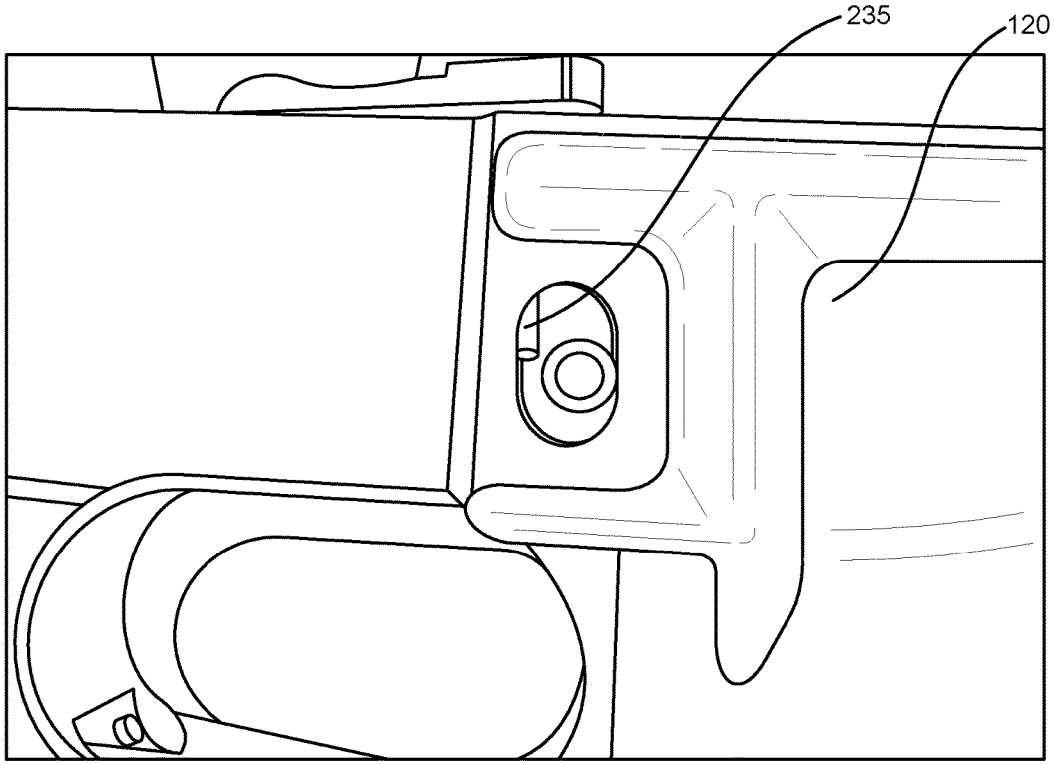
FIG. 10 is an image illustrating the portion of the magazine release interlock mechanism that is positioned behind the magazine release button when the mechanism is positioned at an angle of 3 degrees.

In some embodiments the design of a standard production lower receiver 120 may optimally position cavity 305 as shown in FIG. 5 so that minimum wall thicknesses in lower receiver 120 can be maintained and the wall of upper receiver 125 (see FIG. 2) can reliably engage actuation portion 240 of translatable pin 220. In some embodiments, locating cavity 305 as shown in FIG. 5 may move locking portion 235 of translatable pin to the left in FIG. 2 such that it may not reliably prevent magazine release button 145 from being depressed. In such embodiments, magazine release interlock mechanism 215 can be oriented at angle 250 as illustrated in FIG. 2. Angle 250 can be appropriately chosen so locking portion 235 of translatable pin 220 is positioned substantially behind magazine release button 145 when magazine release interlock mechanism 215 is engaged so it provides a reliable interlock. The location of locking portion 235 can be more clearly seen in FIG. 10 that shows an embodiment with magazine release interlock mechanism 215 oriented at an angle 240 of 87 degrees. As illustrated in FIG. 10, when oriented at angle 240 of 87 degrees, a relatively small portion of locking portion 235 is positioned behind the magazine release button. Therefore, when oriented at an angle 240 greater than 87 degrees there will be a smaller portion of locking portion 235 behind the magazine release button.

Figure 8:
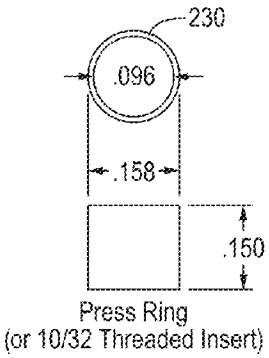
FIGS. 6-8 are side views of components of the magazine release interlock mechanism employed in the rifle shown in FIG. 1.
Figure 7:
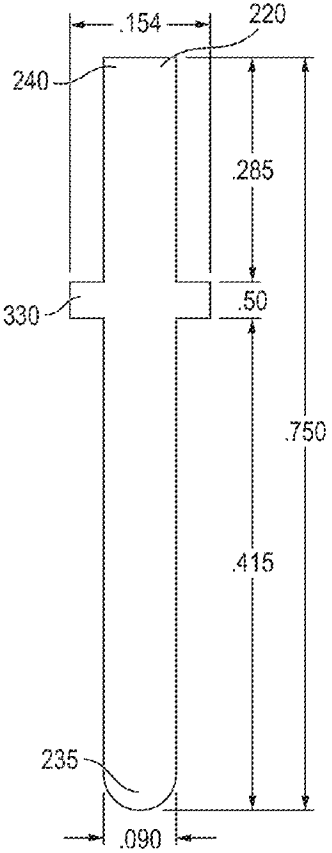
Figure 6:
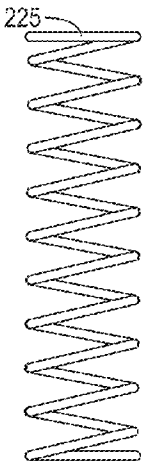

Now referring to FIGS. 6-8 the components of one embodiment of magazine release interlock mechanism 215 are illustrated. FIGS. 6-8 show one embodiment of each component, however variations and modifications of these components are within the scope of this disclosure.

Figure 9:
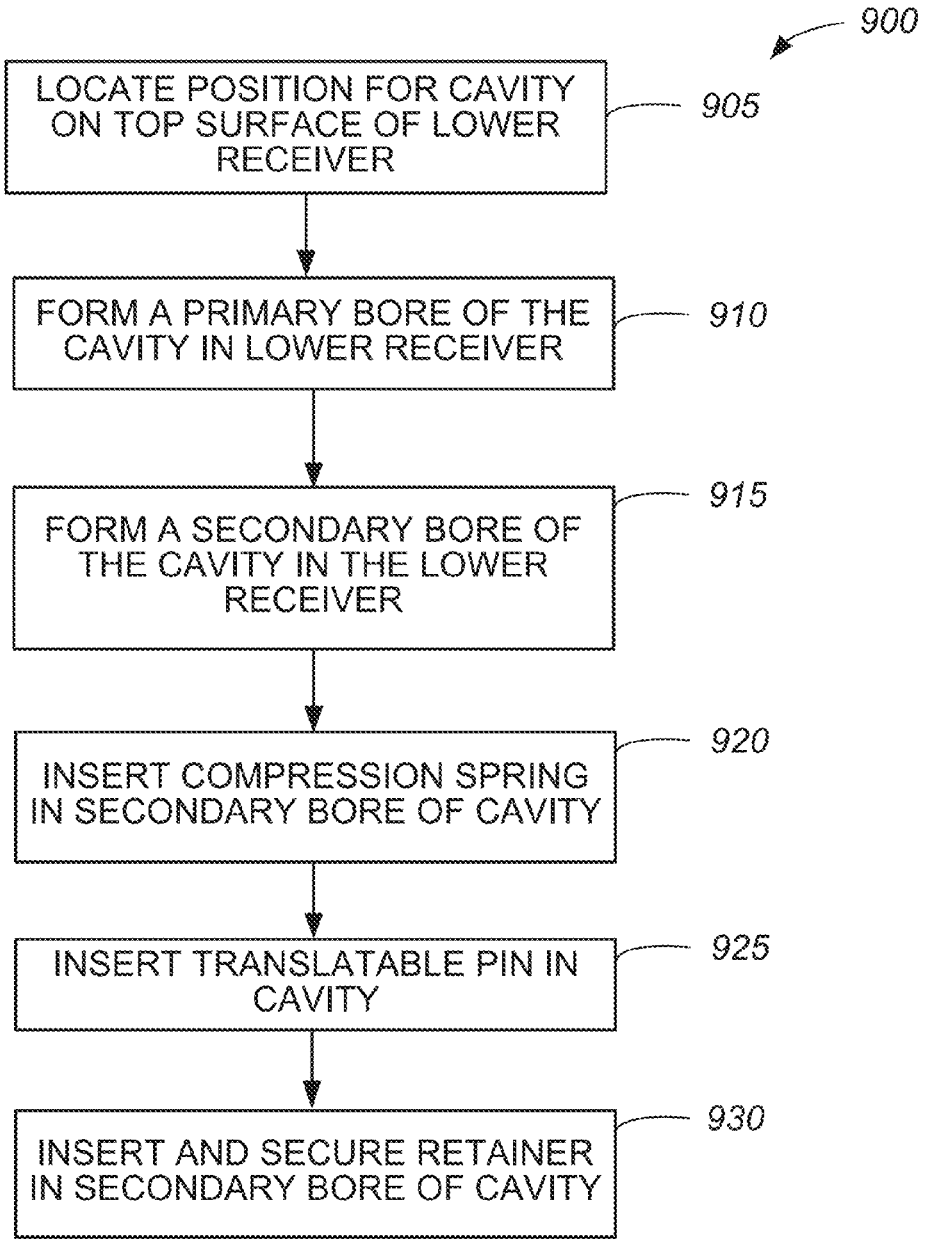
FIG. 9 is a method of forming a magazine release interlock mechanism in a rifle, according to embodiments of the invention.

FIG. 9 illustrates a method 900 for forming a magazine release interlock mechanism in a firearm, according to embodiments of the invention. Method 900 can be used for manufacturing new receivers and can also be used as a kit for modifying existing receivers.

In step 905 a position for a cavity for the magazine release interlock mechanism is located. In some embodiments the position for the cavity can be keyed off of the pivot between the upper and lower receiver and the bolt catch slot, however other methods may be used such as a drill template that registers with the lower receiver.

In step 910 a primary bore for the cavity is formed in the lower receiver. The primary bore can be formed from the top surface of the lower receiver and extends into the cavity for the magazine release button. The diameter of the primary bore can be between 0.050 inches and 0.200 inches. The primary bore can be formed by drilling or any other method.

In step 915 a secondary bore for the cavity is formed in the lower receiver. The secondary bore can be formed from the top surface of the lower receiver and extends a portion of the depth of the primary bore. The secondary bore can also be referred to as a counter-bore and is of a larger diameter than the primary bore.

In step 920 a compression spring is inserted within the secondary bore of the cavity. In step 925 a locking portion of a translatable pin is inserted into the cavity and the translatable pin is positioned within the cavity until a shoulder of the pin is in contact with the compression spring.

In step 930 a retainer is inserted and secured within the secondary bore of the cavity. In some embodiments the retainer is press fit within the secondary bore while in other embodiments an additional step is needed to first form threads in the secondary bore then the retainer is screwed into the primary bore. In some embodiments a threaded insert can enable magazine release interlock mechanism 215 to be easily removed and/or repaired since retainer can be easily removed and replaced. Myriad methods can be used to secure the retainer within the secondary bore including, but not limited to, epoxy, swaging brazing and welding.

Figure 11:
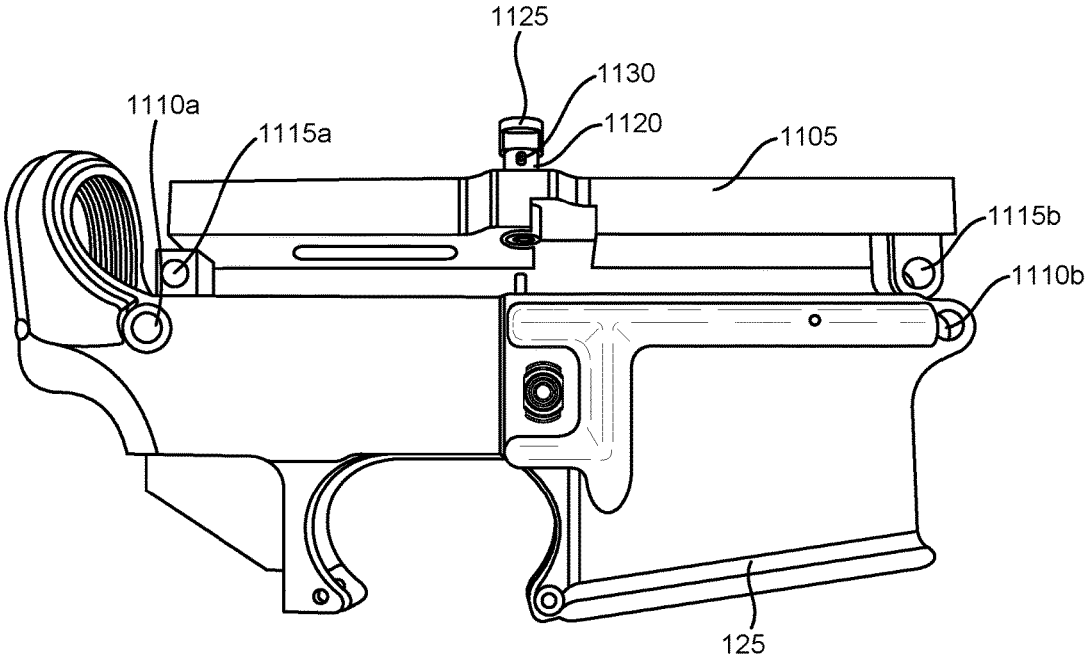
FIG. 11 is an image of a fixture that can be used to position and form the cavity required to accommodate the magazine release interlock mechanism into the lower receiver.

Now referring to FIG. 11 a fixture 1105 for modifying a standard production lower receiver 125 is illustrated. Fixture 1105 can be accurately positioned and keyed to lower receiver 125 using holes 1110*a*, 1115*a* in receiver that align with corresponding holes 1110*b*, 1115*b* in fixture 1105. That is, when employed, fixture 1105 will be moved downward in FIG. 11 such that hole 1110*a* aligns with hole 1110*b* and hole 1115*a* aligns with hole 1115*b*. Pins (not shown) can then be placed through the aligned holes to hold fixture 1105 in place.

Fixture 1105 can include a bushing 1120 that is fixably secured within the fixture body by press fit or other means. One or more drill guides 1125 can be fit within bushing 1120 and held in place by set screw 1130 as described in more detail below. Bushing 1120 and one or more drill guides 1125 can be used to drill one or more bores to form cavity 305 (see FIG. 5) as described in method 900 above. More specifically, In step 910 a primary bore for the cavity is formed in the lower receiver using a first drill guide. The primary bore can be formed from the top surface of the lower receiver and extends into the cavity for the magazine release button. The primary bore can be formed by drilling or any other method.

In step 915 a secondary bore for the cavity is formed in the lower receiver using a second drill guide. The secondary bore can be formed from the top surface of the lower receiver and extends a portion of the depth of the primary bore. The secondary bore can also be referred to as a counter-bore and is of a larger diameter than the primary bore. Cross-sections of the primary and secondary bores are shown in FIGS. 3 and 4. As described above, in some embodiments secondary bore can then be threaded to receive a threaded retainer. In such embodiments a tap guide (not shown, but similar in configuration to drill guides 1125) can be fit within bushing and held in place to assist in forming threads in secondary bore.

As described above, fixture 1110 can be used to accurately position cavity 305 (see FIG. 5) in lower receiver 120. As further described above in some embodiments magazine release interlock mechanism 215 can be positioned at angle 240 and therefore cavity 305 can be formed at a matching angle. Fixture 1110 can include bushing 1120 and drill guide 1125 that are formed at a corresponding angle within the fixture.

Figure 12:
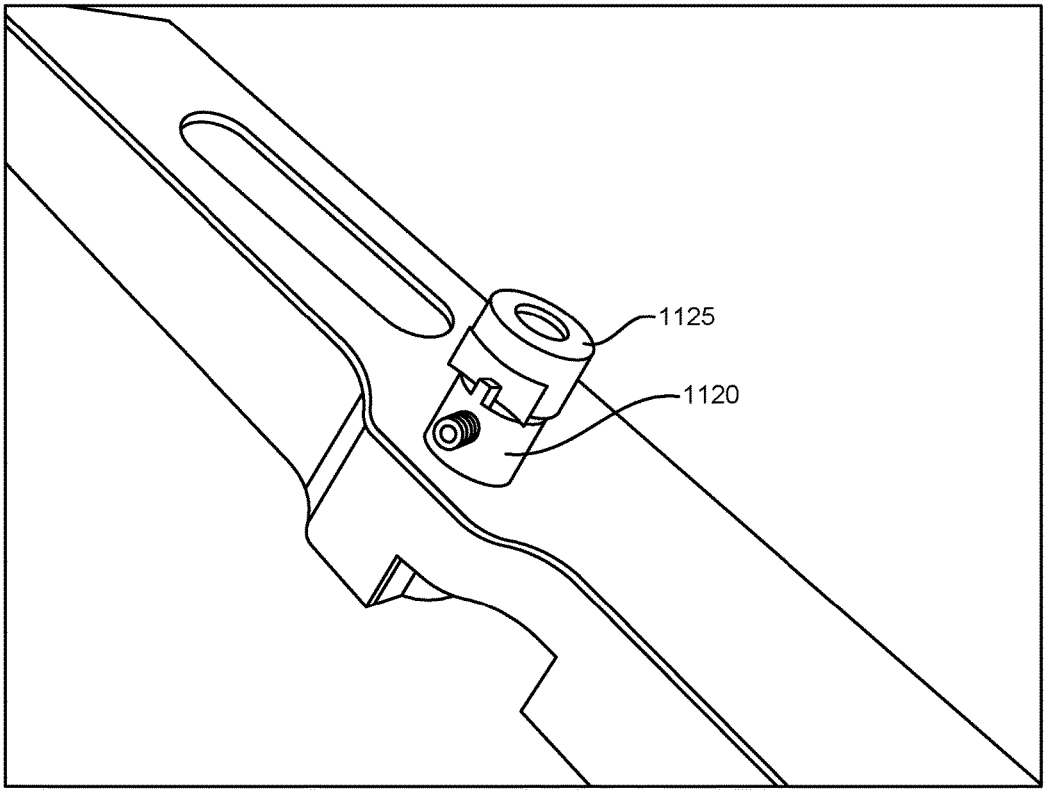
FIG. 12 is an image of the bushing and the drill guide within the fixture.
Figure 13:
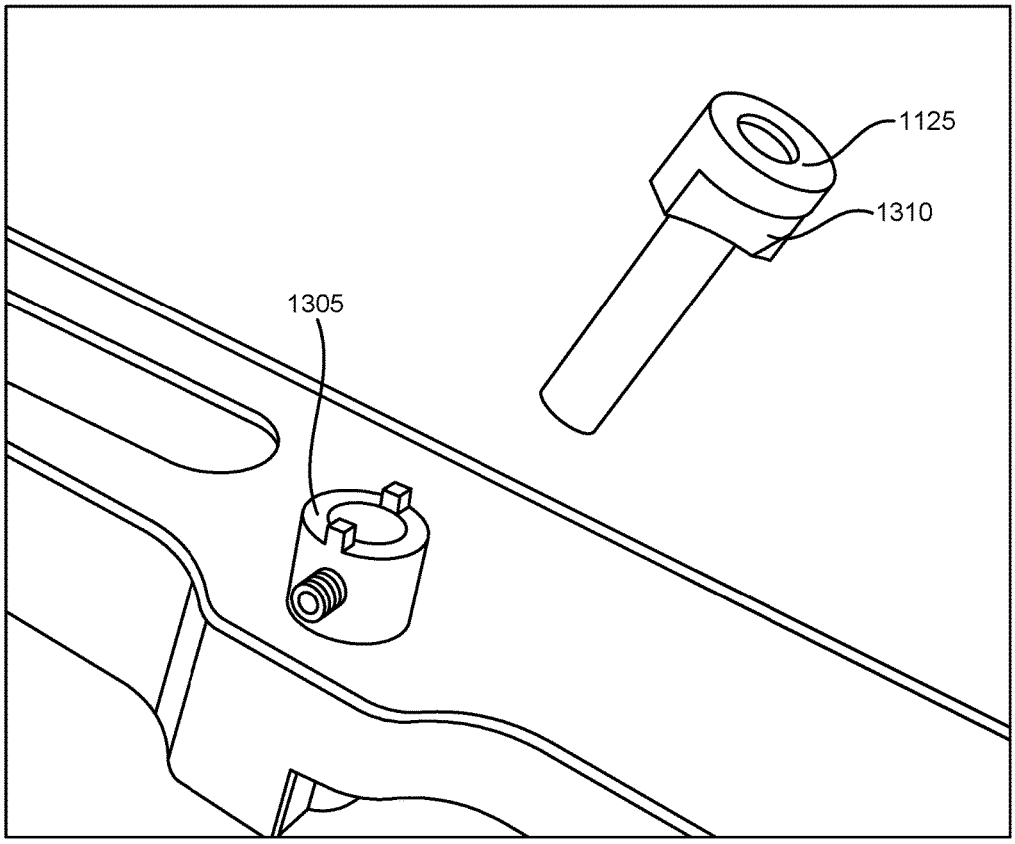
FIG. 13 is an image of the drill guide removed from the bushing.

FIGS. 12 and 13 illustrate bushing 1120 and drill guide 1125 in more detail. In some embodiments bushing 1120 can include one or more extensions 1305 that can be positioned proximate one or more flats 1310 on drill guide, forming an anti-rotation interlock to keep drill guide 1125 from rotating while an operator is forming cavity 305. In some embodiments set screw 1130 can also assist in fixably retaining drill guide 1125 within bushing 1120 during the formation of cavity 305. As shown in FIG. 13, drill guide can include an extended portion that fits within bushing 1120 to facilitate accurate alignment.

Although embodiments of the magazine release interlock mechanism are described above as having particular features and characteristics this disclosure is not limited to any particular design. Any type of mechanism that disables the magazine release button when the receiver is in a closed position is within the scope of this disclosure. For example, in some embodiments the translatable pin can be configured to engage the magazine release button itself (such as with a hole in the button) rather than sliding behind the button. In other embodiments the pin may only engage a portion of the magazine release button such as a slot formed in the side of the button. In yet further embodiments the mechanism can be placed on the opposite side of the receiver and can interact with other portions of the magazine release mechanism. These and other variations are within the scope of this disclosure.

Although rifle 100 (see FIG. 1) is described and illustrated as one particular firearm, embodiments of the disclosure are suitable for use with a multiplicity of firearms. For example, any firearm that has a magazine release button and a receiver can be used with embodiments of the disclosure. In some instances, embodiments of the disclosure are particularly well suited for use with receivers that separate into an upper and a lower receiver to provide a means for actuating the magazine release interlock mechanism. As used herein, a firearm includes any device that is capable of receiving a round of ammunition and discharging the round. Such devices can include, for example, semi-automatic and automatic rifles of any caliber, pistols and shotguns as well as all military firearms.

For simplicity, various internal components, such as the complete magazine release mechanism, the firing mechanism and other components of rifle 100 (see FIG. 1) are not shown in the figures.

In the foregoing specification, embodiments of the disclosure have been described with reference to numerous specific details that can vary from implementation to implementation. The specification and drawings are, accordingly, to be regarded in an illustrative rather than a restrictive sense. The sole and exclusive indicator of the scope of the disclosure, and what is intended by the applicants to be the scope of the disclosure, is the literal and equivalent scope of the set of claims that issue from this application, in the specific form in which such claims issue, including any subsequent correction. The specific details of particular embodiments can be combined in any suitable manner without departing from the spirit and scope of embodiments of the disclosure.

Additionally, spatially relative terms, such as "bottom or "top" and the like can be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as a "bottom" surface can then be oriented "above" other elements or features. The device can be otherwise oriented (e.g., rotated 90 degrees or at other orientations) and the spatially relative descriptors used herein interpreted accordingly.

What is claimed is:

1. A locking mechanism for a magazine release button on a firearm, the locking mechanism comprising:

a translatable pin including an actuation portion positioned at a first end and a locking portion positioned at a second end, a cylindrical retainer having an outer surface attached to a receiver of the firearm and a bore sized and positioned to receive the actuation portion of the translatable pin;

wherein the receiver includes an upper portion and a lower portion;

werein the button includes a head having an outer surface positioned opposite an inner surface;

wherein when the receiver is moved from a closed position to an open position the acuation portion of the translatable pin translates through the bore such that the actuation portion extends out of a top surface of the lower portion of the receiver and the locking portion of the translatable pin is positioned adjacent the button allowing the button to be operated to release the magazine; and wherein when the receiver is moved from the open position to the closed position the upper portion of the receiver forces the actuation portion of the translatable pin to translate through the bore of the retainer such that the locking portion is positioned adjacent the inner surface of the button to obstruct operation of the button and prevent release of the magazine.

2. The locking mechanism of claim 1 wherein the translatable pin moves in a first direction when the receiver of the firearm is moved to the closed position and moves in a second direction that is opposite the first direction when the receiver of the firearm is moved to the open position.

3. The locking mechanism of claim 1 wherein the firearm is a rifle.

4. The locking mechanism of claim 3 wherein the firearm is an AR-15 rifle.

5. The locking mechanism of claim 1 wherein the receiver includes an upper portion pivotably connected to a lower portion.

6. The locking mechanism of claim 5 wherein the receiver is in the closed position when the upper portion is rotated towards the lower portion and latched into place against the lower portion.

7. The locking mechanism of claim 5 wherein the receiver is in the open position when the upper portion is rotated away from the lower portion.

8. A rifle modification kit comprising:

a translatable pin including an actuation portion positioned at a first end and a locking portion positioned at a second end;

a compression spring; and a cylindrical retainer having an outer surface attached to the rifle and a bore sized and positioned to receive the actuation portion of the translatable pin;

wherein the rifle has a receiver that includes an upper portion and a lower portion, and the rifle further includes a magazine release button that includes a head having an outer surface positioned opposite an inner surface;

wherein when the receiver of the rifle is moved from a closed position to an open position the actuation portion of the translatable pin translates through the bore such that the actuation portion extends out of a top surface of lower portion of the receiver and the locking portion of the translatable pin is positioned adjacent the button allowing the button to be operated to release the magazine; and wherein when the receiver is moved from the open position to the closed position the upper portion of the receiver forces the actuation portion of the translatable pin to translate through the bore of the retainer such that the locking portion is positioned adjacent the inner surface of the button to obstruct operation of the button and prevent release of the magazine.

9. The rifle modification kit of claim 8 wherein the translatable pin is positioned within the receiver at an angle between 80 and 90 degrees relative to a top surface of the receiver.

10. The rifle modification kit of claim 8 wherein the translatable pin is positioned within the receiver at an angle between 85 and 87 degrees relative to a top surface of the receiver.

11. The rifle modification kit of claim 8 wherein the translatable pin includes a shoulder portion that compresses the compression spring when the receiver of the rifle is in the closed position.

12. The rifle modification kit of claim 8 wherein the retainer includes external threads and is configured to be screwed into place within the receiver.

* * * * *